US006516165B2

(12) United States Patent
Makihira et al.

(10) Patent No.: US 6,516,165 B2
(45) Date of Patent: Feb. 4, 2003

(54) FIXING APPARATUS AND IMAGE FORMING APPARATUS HAVING THE FIXING APPARATUS

(75) Inventors: Tomoyuki Makihira, Shizuoka (JP); Yasunari Kobaru, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/910,045

(22) Filed: Jul. 23, 2001

(65) Prior Publication Data

US 2002/0041772 A1 Apr. 11, 2002

(30) Foreign Application Priority Data

Jul. 27, 2000 (JP) ..... 2000-227402

(51) Int. Cl.[7] ..... G03G 15/20
(52) U.S. Cl. ..... 399/69; 399/331
(58) Field of Search ..... 399/69, 70, 330, 399/331; 219/216

(56) References Cited

U.S. PATENT DOCUMENTS 5,124,756 A * 6/1992 Stelter ..... 399/69
5,517,293 A * 5/1996 Tonai et al. ..... 399/70 X
5,701,556 A * 12/1997 Sugimoto ..... 399/330 X
5,875,372 A * 2/1999 Sato et al. ..... 399/69 X
5,937,230 A * 8/1999 Iwase et al. ..... 399/69
5,978,618 A * 11/1999 Yamamoto et al. ..... 399/69

FOREIGN PATENT DOCUMENTS

JP 54-88134 * 7/1979

* cited by examiner

*Primary Examiner*—Fred L Braun
(74) *Attorney, Agent, or Firm*—Fitzpatrick, Cella, Harper & Scinto

(57) ABSTRACT

A fixing apparatus in which an unfixed image is fixed on a recording medium for bearing the unfixed image by pinching and conveying the recording medium by using a fixing body and a pressure body, wherein in the fixing apparatus in which the pressure body has a core metal, an elastic body layer for covering an outer periphery of the core metal, and a mold releasing layer for covering an outer periphery of a elastic body layer, the controller sets electric energy per predetermined time supplied from the power supply to the pressure body heater to a predetermined quantity or a lower quantity in such a manner that a temperature of the core metal of the pressure body is maintained at a predetermined temperature or a lower temperature.

28 Claims, 8 Drawing Sheets

FIXING APPARATUS AND IMAGE FORMING APPARATUS HAVING THE FIXING APPARATUS

BACKGROUND OF THE INVENTION

1. Field of the Invention

The present invention relates to an image forming apparatus using an electrophotographic system.

2. Related Background Art

Conventionally, in an image forming apparatus adopting an electrophotographic system, a laser printer and the like have been known. Description will be given as to a fixing apparatus provided to a prior art image forming apparatus.

In the fixing apparatus provided to the prior art image forming apparatus, a heat fixing apparatus is often used in order perform fixing processing on transferring paper which is a recording medium for bearing a toner image as an unfixed image. That is because the heat fixing apparatus has many merits. For example, the heat fixing apparatus is superior in the storage stability, capable of supporting various devices from a low-speed device to a high-speed device, and has many options of toner. Further, there has been conventionally known a fixing apparatus configured to heat a pressure roller from the inside in order to prevent the pressure roller as a pressure body from being fouled.

Here, a heat roller fixing apparatus as an example of such a fixing apparatus will be described in detail based on FIG. 7.

FIG. 7 is a cross-sectional view showing a schematic structure of a heat roller fixing apparatus.

The heat roller fixing apparatus includes: a fixing roller 121 as a fixing body; a pressure roller 122 as a pressure body; a heater 135(*a*) as fixing body heating means which is a halogen lamp as a heating source for the fixing roller 121; a heater 135(*c*) as pressure body heating means which is a halogen lamp as a heating source for the pressure roller 122; temperature adjusting thermistors 129 and 130 as temperature detecting means for the fixing roller 121 and the pressure roller 122; a release claw 125; and a fixing inlet guide 134. In this example, the both temperature adjusting thermistors 129 and 130 are provided in non-image areas. It is to be noted that the temperature adjusting thermistor 130 is used for a non-printing surface side and it may be hence provided at the center.

The fixing roller 121 is configured to have a primer layer (not shown) as an adhesive layer on a hollow core metal 123 made of aluminium, iron or stainless steel and further a fluorocarbon resin layer 124 on the primer layer. As to a thickness of the primer layer (not shown), 5 to 20 $\mu$m is appropriate, and 30 to 70 $\mu$m is appropriate for a thickness of the fluorocarbon resin layer 124. This fluorocarbon resin layer 124 may be formed by using a tube consisting of PFA resin or by baking the PFA resin.

Since the fixing roller 121 is constituted attaching a high value on the mold releasing property of the surface, the fluorocarbon resin is constituted by pure PFA resin in which a filler is not mixed. A silicon rubber layer may be provided between the fluorocarbon resin layer 124 and the core metal 123 according to needs.

The pressure roller 122 has a structure that an elastic body layer 127 consisting of silicon rubber having the heat resistance is bonded on a hollow core metal 126 consisting of aluminium, iron or stainless steel through a primer layer (not shown) and a PFA resin tube 128 is applied on the uppermost layer portion. As this PFA resin tube 128, there is used a material in which carbon is mixed so that the resistance value becomes $10^4$ to $10^{12}$ Ω·cm in order to increase the bias effect from the pressure roller.

The heaters 135(*a*) and 135(*c*) as heating sources for the fixing roller 121 and the pressure roller 122 are provided inside the fixing roller 121 and the pressure roller 122, respectively, and the heater 135(*a*) and the heater 135(*c*) are configured to be driven by the same power supply circuit as controlling means. By using one drive circuit for the heater 135(*a*) and the heater 135(*c*), the heater 135(*a*) in the fixing roller 121 and the heater 135(*c*) in the pressure roller 122 can be alternatively energized in accordance with each control unit (in this example 1000 ms) which is a predetermined period in time with a predetermined time length ratio (which will be referred to as a lighting ratio hereinafter), and more power can be supplied to the fixing roller 121 provided on a printing surface side (side carrying the toner 132) of the transferring material to be subjected to fixation, thereby avoiding the power loss caused due to a switching time of a switching device.

Here, FIG. 8 shows a heater lighting result when an A4-size landscape sheet and an LGL-size sheet are supplied.

As shown in FIG. 8, in case of feeding the A4-size landscape sheet, the heater 135(*a*) is in the on state with the time length of 80% in the control unit in order to maintain the fixing roller 121 at a fixed temperature. Since the heater 135(*a*) and the heater 135(*c*) are alternatively turned on, the heater 135(*c*) is in the on state only 20%. On the contrary, in case of feeding the LGL-size sheet, the heater 135(*a*) is in the on state only 40% in order to maintain the fixing roller 121 constant, and the heater 135(*c*) is in the on state 60%. The paper size and the heater lighting ratio of each roller are as shown in Table 1.

TABLE 1

| Paper size x (mm) | Lighting ratio (%) of fixing heater | Lighting ratio (%) of pressure heater |
|---|---|---|
| A4-size landscape sheet and others ($x \geqq 297$) | 90 | 10 |
| LTR-size landscape sheet and others ($279 \leqq x < 297$) | 80 | 20 |
| B4-size landscape sheet and others ($257 \leqq x < 279$) | 60 | 40 |
| LGL/envelope and others ($x < 257$) | 40 | 60 |

When the heater 135(*a*) is not turned on, the high fixing property can be satisfied by heating the pressure roller 122 from the inside. In the above-described structure, both the hardness and the wall thickness of the pressure roller 122 are restricted in order to maintain a nip width to a fixed value or a higher value.

However, the above-described conventional structure/controller have the following drawbacks.

In the structure mentioned above, since the wall thickness of the pressure roller is large, a considerable difference in temperature is generated between the core metal temperature and the surface temperature of the pressure roller depending on the lighting ratio of the heater for the pressure roller. The heater control is determined based on a temperature of the fixing roller on the printing surface side on which the fixing property greatly depends. Therefore, when the power size is small, excessive power is supplied to the heater for the pressure roller, thereby increasing the temperature of the core metal of the pressure roller. As a result, the primer between the core metal and the rubber is deteriorated, and the pressure roller is damaged.

SUMMARY OF THE INVENTION

Therefore, it is an object of the present invention to provide a fixing apparatus and an image forming apparatus having this fixing apparatus capable of avoiding thermal degradation of a pressure body due to excessive increase in temperature of a core metal of the pressure body.

To achieve this aim, according to the present invention, there is provided a fixing apparatus or an image forming apparatus, comprising: a fixing body and a pressure body which are pressed against each other and rotate; fixing body heating means for heating the fixing body upon receiving supply of power from a power supply; pressure body heating means for heating the pressure body upon receiving supply of power from the power supply; temperature detecting means for detecting a temperature of at least one of the fixing body and the pressure body; and controlling means for controlling power supplied to the fixing body heating means and the pressure body heating means from the power supply in such a manner that a temperature detected by the temperature detecting means becomes a predetermined set temperature, an unfixed image being fixed on a recording medium by heating and pressing the recording medium bearing the unfixed image while pinching and conveying the recording medium, the pressure body having a core metal, an elastic body layer covering an outer periphery of the core metal, and a mold releasing layer covering an outer periphery of the elastic body layer, wherein the controlling means sets the electric energy per predetermined time supplied from the power supply to the pressure body heating means to be equal to or lower than a predetermined quantity in such a manner that a temperature of the core metal of the pressure body is maintained at a predetermined temperature or a lower temperature.

According to the present invention, since the electric energy per predetermined time supplied from the power supply to the pressure body heating means is set to a predetermined quantity or a lower quantity by the controlling means in such a manner that a temperature of the core metal of the pressure body is maintained at a predetermined temperature or a lower temperature, it is possible to avoid thermal degradation of the pressure body due to excessive increase in temperature of the core metal of the pressure body.

Preferably, a power supply circuit for the fixing body heating means sets the electric energy per predetermined time supplied from the power supply to the pressure body heating means to a predetermined quantity or a lower quantity in such a manner that a temperature of the core metal of the pressure body can be maintained at a predetermined temperature or a lower temperature. Since the power supply circuit for the fixing body heating means sets the electric energy per predetermined time supplied from the power supply to the pressure body heating means to a predetermined quantity or a lower quantity in such a manner that a temperature of the core metal of the pressure body is set at a predetermined temperature or a lower temperature, it is possible to prevent thermal degradation of the pressure body caused due to excessive increase in temperature of the core metal of the pressure body.

Preferably, by the controlling means, the fixing body heating means and the pressure body heating means are driven by the same power supply (source) circuit.

Preferably, with the controlling means, by setting a value of a voltage supplied form the power supply to the pressure body heating means so as to be small as a width of the recording medium to be subjected to fixation in a direction orthogonal to a conveying direction becomes small, the electric energy per predetermined time supplied from the power supply to the pressure body heating means is set to a predetermined quantity or a lower quantity. Since a value of the voltage from the power supply to the pressure body heating means can be set smaller by the controlling means as the width of the recording medium to be subjected to fixation becomes small, it is possible to prevent thermal degradation of the pressure body caused due to excessive increase in temperature of the core metal of the pressure body.

Preferably, the temperature detecting means detects a temperature of the pressure body. The temperature detecting means detects a temperature of the pressure body, and the electric energy per predetermined time supplied from the power supply to the pressure body heating means is set to a predetermined quantity or a lower quantity by the controlling means so that a temperature of the core metal of the pressure body can be maintained at a value not more than a predetermine value based on the above-mentioned temperature, thereby avoiding thermal degradation of the pressure body caused due to excessive increase in temperature of the core metal of the pressure body.

Preferably, the temperature detecting means detects a temperature of the core metal of the pressure body. The temperature detecting means detects a temperature of the core metal of the pressure body, and the electric energy per predetermined time supplied from the power supply to the pressure body heating means is set to a predetermined quantity or a lower quantity by the controlling means so that the above-described temperature can be maintained at a predetermined temperature or a lower temperature, thereby preventing thermal degradation of the pressure body caused due to excessive increase in temperature of the core metal of the pressure body.

Preferably, the fixing body heating means is constituted by two fixing body heating bodies having luminous intensity distributions different from each other, which are provided inside the fixing body and generate heat by power from the power supply. The pressure body heating means is constituted by one pressure body heating body which is provided inside the pressure body and generates heat by power from the power supply. Any one of the two fixing body heating bodies and the pressure body heating body are driven by the same power supply circuit. By using the power supply circuit for one fixing body heating body, the electric energy per predetermined time supplied from the power supply to the pressure body heating body is set to a predetermined quantity or a lower quantity so that a temperature of the core metal of the pressure body can be maintained at a predetermined temperature or a lower temperature, thereby preventing thermal degradation of the pressure body caused due to excessive increase in temperature of the core metal of the pressure body.

Preferably, with the controlling means, a set temperature for the pressure body heating means is determined so as to be small as the width of the recording medium to be subjected to fixation in a direction orthogonal to a conveying direction becomes smaller, thus setting the electric energy per predetermined time supplied from the power supply to the heating body heating means to a predetermined quantity or a lower quantity. By the controlling means, a value of the voltage from the power supply to the pressure body heating means is set so as to be small as the width of the recording medium to be subjected to fixation is decreased so that a temperature of the core metal of the pressure body can be maintained at a predetermined temperature or a lower temperature, and it is hence possible to prevent thermal degradation of the pressure body caused due to excessive increase in temperature of the core metal of the pressure body.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Preferred embodiments according to the present invention will now be described with reference to the accompanying drawings.

First Embodiment

A first embodiment according to the present invention will be first explained.

Figure 1:
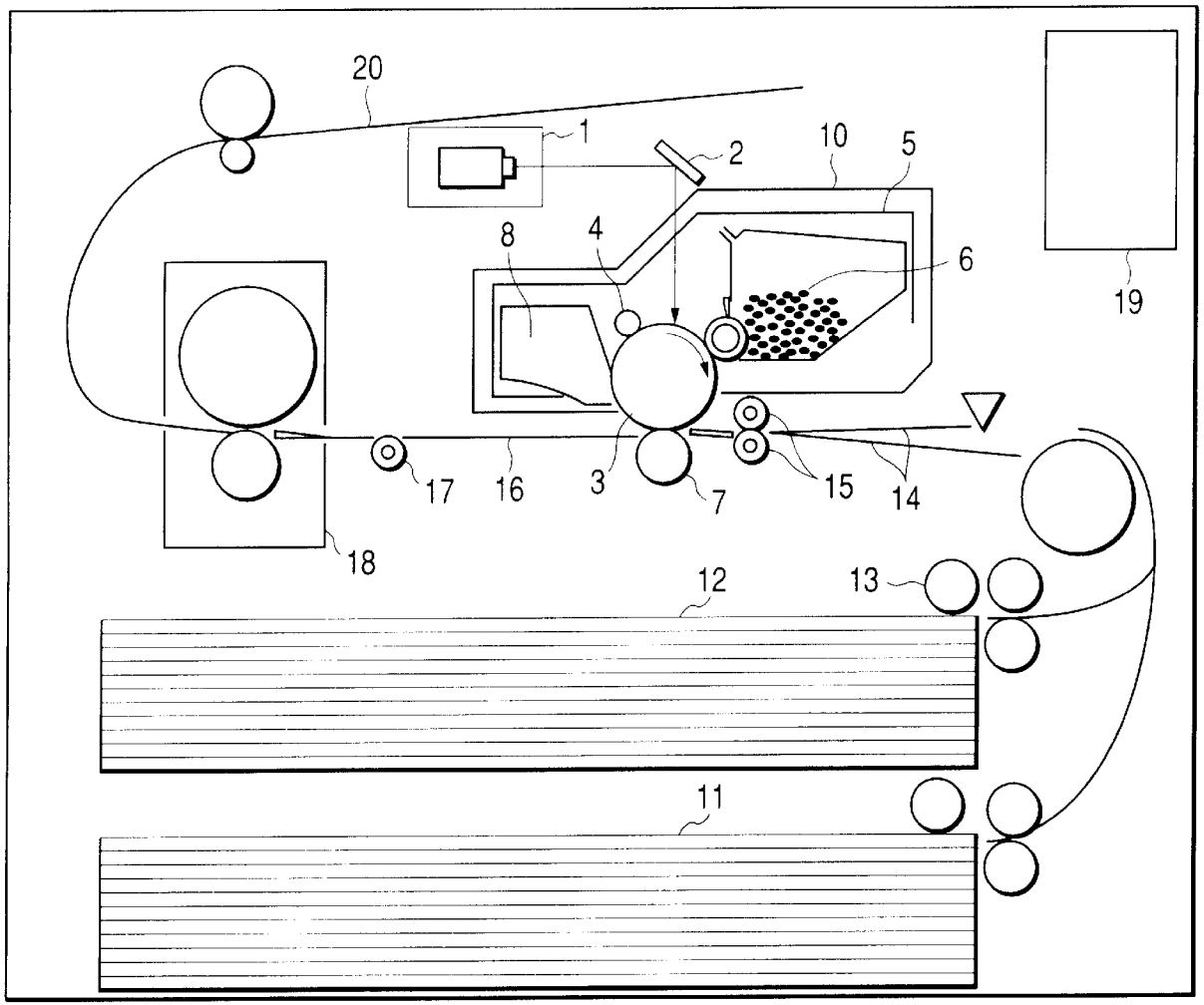
FIG. 1 is a cross-sectional view showing a schematic structure of an image forming apparatus according to a first embodiment of the present invention.

FIG. 1 is a cross-sectional view showing a schematic structure of an image forming apparatus according to this embodiment.

This image forming apparatus includes, as shown in FIG. 1, a scanner unit 1 having optical means and scanning means for emitting and scanning a laser beam transmitted in accordance with image information, and a process cartridge 10 including therein main image forming means.

The process cartridge 10 is constituted by a photosensitive drum 3 as a latent image bearer, a roller charger 4 consisting of semi-conductive rubber, a developing apparatus 5 for developing toner 6 on the photosensitive drum 3, a cleaner 8 for removing waste toner from the photosensitive drum 3, and others.

The photosensitive drum 3 in the process cartridge 10 rotates in a direction indicated by an arrow. After the surface of the photosensitive drum 3 is uniformly charged by the roller charger 4, the photosensitive drum 3 is irradiated with a laser beam emitted by the scanner unit 1 through a mirror 2, thereby forming an electrostatic latent image on the surface thereof. Further, toner is supplied by the developing apparatus 5, and this electrostatic latent image is visualized as a toner image.

On the other hand, transferring materials (weighting capacity, basis weight: 64 to 128 g) in a sheet feeding cassette 11 are separated one by one and fed by a sheet feeding roller 13. The fed transferring material 12 is conveyed to a pair of registration rollers 15 along upper and lower guides 14. The registration rollers 15 are at a halt till the transferring material 12 reaches them. When the end of the transferring material 12 is brought into contact with the registration rollers 15, skew feeding of the transferring material 12 can be corrected. Subsequently, the registration rollers 15 convey the transferring material 12 to a transferring portion at a position opposed to the photosensitive drum 3 and the transferring roller 7 so as to be synchronized with the end of an image formed on the photosensitive drum 3. It is to be noted that a sheet feeding sensor (not shown) is provided in the vicinity of the registration rollers 15, and the state of paper supply, jam, and a length of the transferring material are detected.

Electric charges whose polarity is opposite to that of the toner is given by the transferring roller 7 from the back side to the transferring material 12 conveyed to the transferring portion as described above, and a toner image formed on the photosensitive drum 3 is transferred onto the transferring material 12. The transferring material 12 to which the toner image has been transferred is conveyed to a heat fixing apparatus 18 by a conveying roller 17 and a conveying guide 16, and the heat fixing apparatus 18 obtains a recording image by fusing and fixing onto the transferring material 12 the unfixed toner image on the transferring material 12 by using heat and pressure. The transferring material 12 after image fixation is ejected to a discharge tray 20 through each conveying roller selected by a flapper.

The heat fixing apparatus 18 will now be described in detail with reference to FIG. 2.

Figure 2:
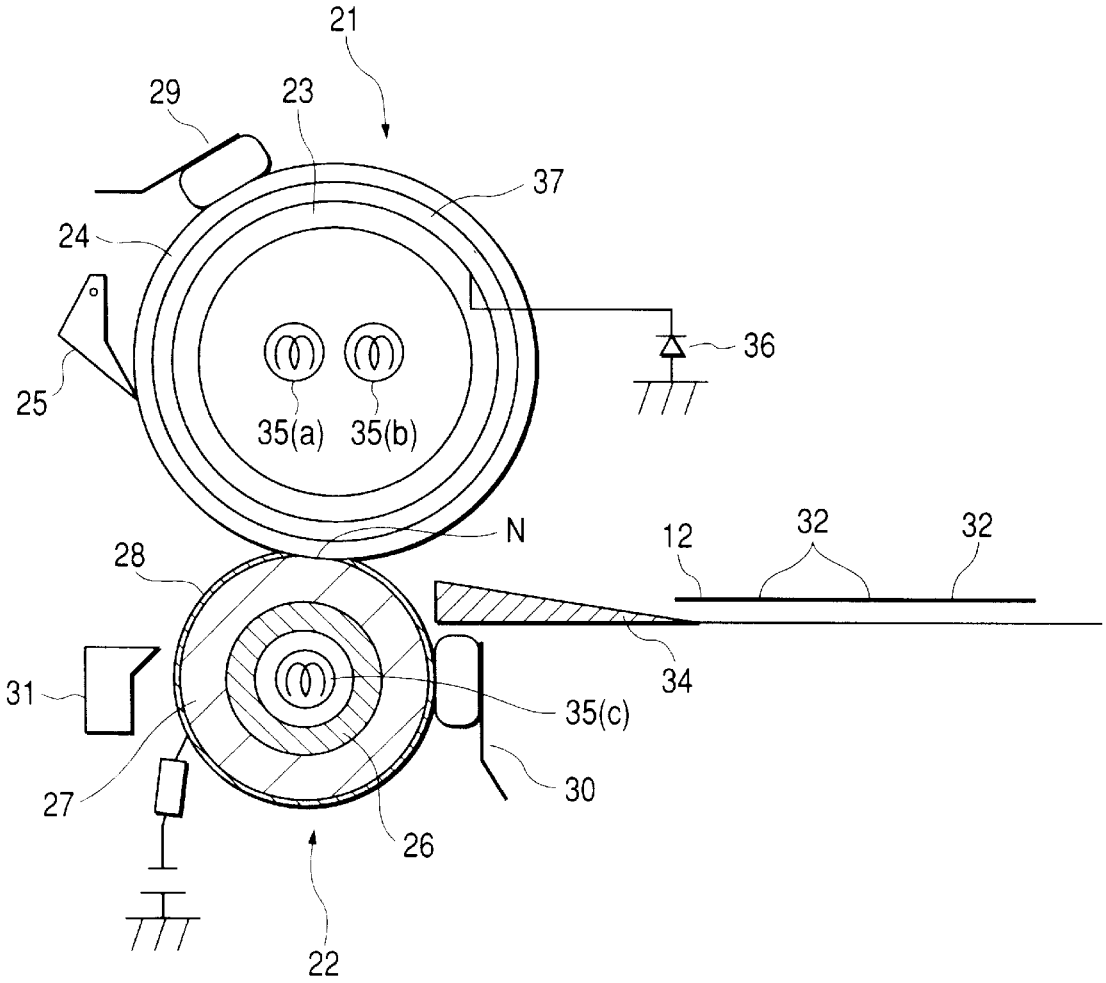
FIG. 2 is a cross-sectional view showing a schematic structure of a fixing apparatus provided to the image forming apparatus depicted in FIG. 1.

FIG. 2 is a cross-sectional view showing a schematic structure of the heat fixing apparatus 18.

The heat fixing apparatus 18 includes a fixing roller 21 as a fixing body, a pressure roller 22 as a pressure body, heaters 35(*a*) and 35(*b*) as fixing body heating means which is halogen lamps as heating sources for the fixing roller, a heater 35(*c*) which is a halogen lamp as pressure body heating means as a heating source for the pressure body, temperature adjusting thermistors 29 and 30 as temperature detecting means for the fixing roller 21 and the pressure roller 22, a separation claw 25, and a fixing inlet guide 34. In this embodiment, the both temperature adjusting thermistors 29 and 30 are provided in non-image areas. It is to be noted that the temperature adjusting thermistor 30 is provided on the non-printing surface side and hence it may be set in the center.

The fixing roller 21 is configured to have a primer layer (not shown) as an adhesive layer on a hollow core metal 23 consisting of aluminium, iron or stainless steel and further have a fluorocarbon resin layer 24 on the primer layer. 5 to 20 $\mu$m is appropriate for a thickness of the primer layer (not shown), and 30 to 70 $\mu$m is appropriate for a thickness of the fluorescent resin layer 24. This fluorescent resin layer 24 may be formed by using a PFA resin tube or by baking PFA resin.

Since the fixing roller 21 is constituted putting a high value on the mold releasing property of the surface thereof, it is constituted by pure PFA resin in which a filler is not mixed in the fluorescent resin. A silicon rubber layer may be provided between the fluorescent resin layer 24 and the core metal 23 according to needs.

The pressure roller 22 has a structure that an elastic body layer 27 consisting of silicon rubber with the heat resistance is bonded on a hollow core metal 26 consisting of aluminium, iron or stainless steel through a primer layer (not shown) and a PFA resin tube 28 is applied on an uppermost layer portion. As this PFA resin tube 28, a material in which carbon is mixed is used so that the resistance value can become $10^4$ to $10^{12}$ Ω·cm in order to increase the bias effect from the pressure roller.

In this embodiment, the heater 35(*a*) and the heater 35(*c*) as heating sources for the fixing roller 21 and the pressure roller 22 are provided inside the fixing roller 21 and the pressure roller 22, and the heater 35(*a*) and the heater 35(*c*) are configured to be driven by the same power supply circuit. A maximum energization heat rate of the heater 35(*c*) is restricted to a predetermined value or a lower value.

The heat fixing apparatus 18 is an example of a central reference that a transferring material whose maximum paper supply size is an A3 (297 mm) width is conveyed with a paper supply center of the apparatus as a reference.

The fixing roller 21 is a roller using aluminium for the core metal and having a diameter of 50 mm and a thickness of 3.0 mm. A fluorocarbon resin layer 24 as a PFA mold releasing layer is applied on the surface layer of the fixing roller 21. In this embodiment, a silicon rubber layer 37 having a thickness of 25 μm is provided between the fluorocarbon resin layer 24 and the core metal 23 in order to improve the fixation property.

The pressure roller 22 has a 5-mm elastic body layer 27 consisting of silicon rubber having the heat resistance on a roller of an aluminium core metal 26 having a diameter of 40 mm and a thickness of 4 mm and a PFA resin tube 28 as a mold releasing layer for the surface layer thereof. The pressure roller 22 having a diameter of 40 mm and the product hardness of 600 is used. When the pressure of 100 N is applied, a nip width of 6.0 mm is formed between the fixing roller 21 and the pressure roller 22.

Further, thermistors as temperature detecting means are provided in non-image areas of the fixing roller 21 and the pressure roller 22. When the fixing roller 21 and the pressure roller 22 are heated from inside by the heater 35(*a*), the heater 35(*b*) and the heater 35(*c*), a surface temperature can be accurately adjusted, thereby assuring the stable fixing property. In this embodiment, printing of 40 sheets of the A4-size landscape/min is enabled in this structure.

The heater 35(*a*), the heater 35(*b*) and the heater 35(*c*) as heating sources for the fixing roller 21 and the pressure roller 22 are provided inside the fixing roller 21 and the pressure roller 22, respectively, and the heater 35(*a*) and the heater 35(*c*) are configured to be driven by the same power supply circuit. The heater 35(*a*) capable of providing a rated output of 700 W upon input of 120 V, the heater 35(*b*) capable of providing a rated output of 300 W upon input of 120 V and the heater 35(*c*) capable of providing a rated output of 300 W upon input of 120 V are used, and the luminous intensity distribution of the heaters are symmetrical with respect to the paper supply reference.

By dividing the heating source for the fixing rollers 21 into two heaters 35(*a*) and 35(*b*), the maximum lighting duty of the heater 35(*c*) is increased, and a heat quantity for heating the pressure roller 22 is also increased, thereby performing heating with power being effectively distributed to the pressure roller 22 side. Furthermore, a number of the drive circuit is one because the power loss caused during changeover of the switching device can be avoided by alternately energizing one heater 35(*a*) in the fixing roller 21 and the heater 35(*c*) in the pressure roller 22.

Figure 3:
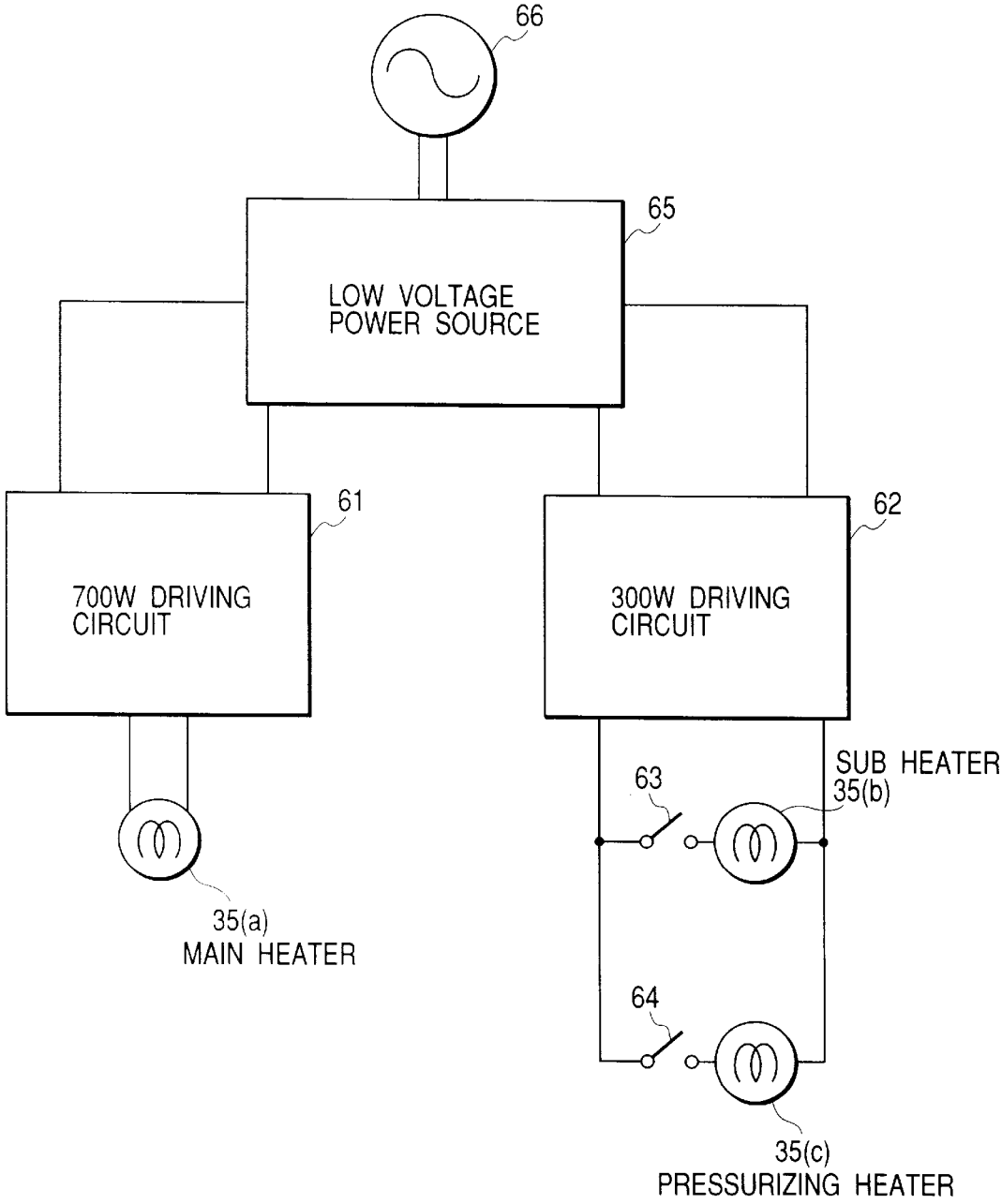
FIG. 3 is a block diagram for illustrating drive control of fixing body heating means and pressure body heating means provided on a fixing apparatus shown in FIG. 2.

Specifically, the controlling means according to this embodiment has, as shown in FIG. 3, a circuit 61 for driving the heater 35(*a*) and a circuit 62 for driving the heater 35(*b*) and the heater 35(*c*). Using these independent two drive circuits can control energization of the heaters 35 consisting of three halogen heaters as heating sources from the power supply.

Switching devices 63 and 64 are connected to the heater 35(*b*) and the heater 35(*c*) and adjust the temperature by selectively switching the heater 35(*b*) and the heater 35(*c*).

In this embodiment, a low-voltage power supply 65 connected to an outlet 66 supplies an alternating voltage of 90 V to 120 V (or 200 V to 230 V) to the circuits 61 and 62.

Figure 4:
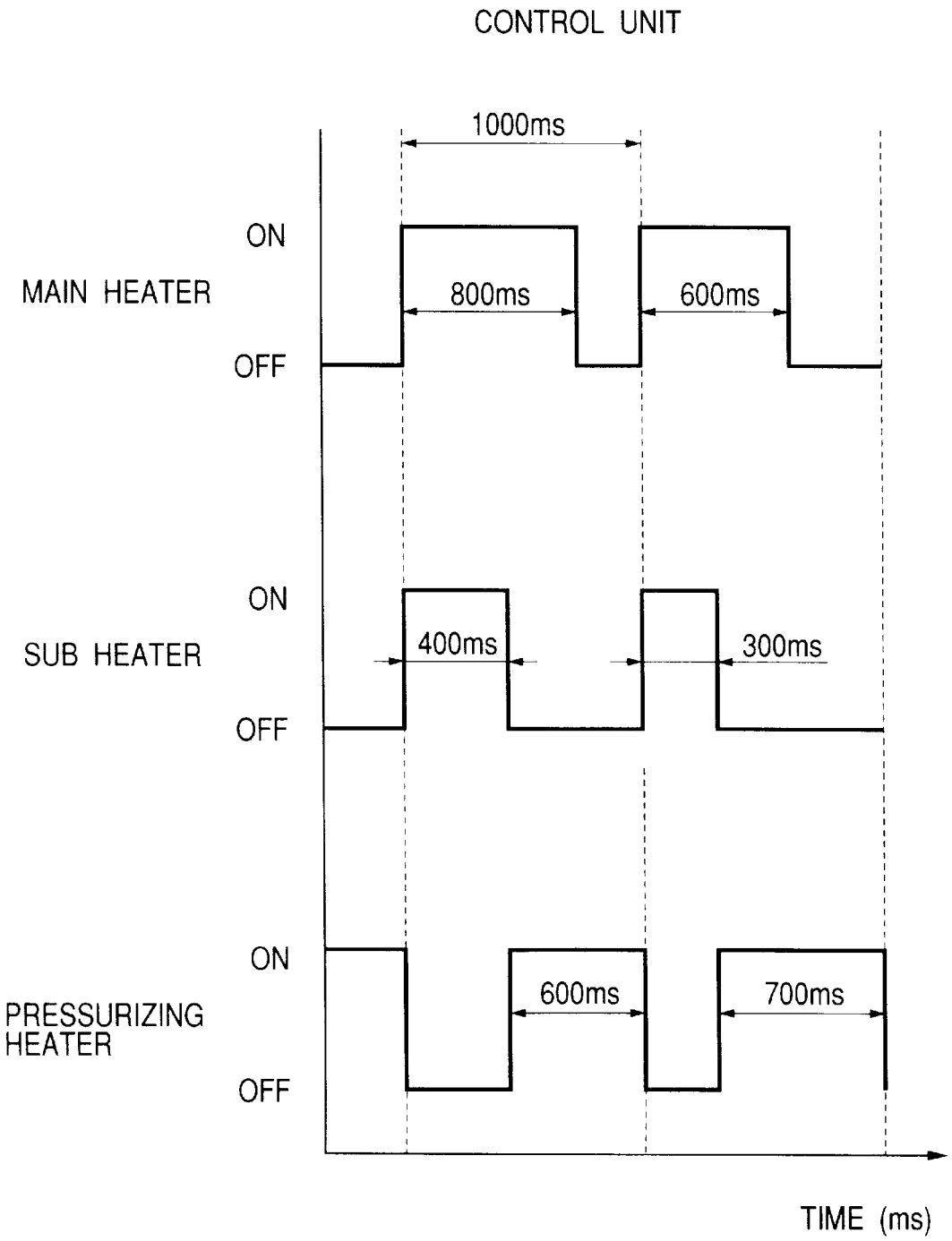
FIG. 4 is a view showing drive timings of the fixing body heating means and the pressure body heating means in the first embodiment according to the present invention.

FIG. 4 shows the lighting control of each heater when paper sheets of the A4 portrait size are continuously printed.

At first, the heater 35(*a*) as a main heater for warming the fixing roller 21 and the heater 35(*b*) as a sub heater are controlled in such a manner that a temperature distribution in the longitudinal direction of the fixing roller 21 is maintained constant by setting the lighting ratio of the heater 35(*a*) and the heater 35(*b*) in the control unit (one second in FIG. 4) to 50% without variation and that a temperature of the fixing roller 21 is maintained at 190° C. which is a set temperature by changing the lighting duty in the control unit while making reference to a thermistor detected temperature.

On the other hand, the pressure heater for warming the pressure roller 22 is controlled in such a manner that the heater 35(*c*) is turned on if a temperature detected by the temperature adjusting thermistor 30 of the pressure roller 22 is not more than a target temperature which is a set temperature when the heater 35(*b*) is in the off state and that the heater 35(*c*) is not turned on if that detected temperature is not less than the target temperature.

Here, the control for driving the heater 35(*c*) for the pressure roller 22 according to this embodiment will now be described.

Since the lighting ratio of the heater 35(*b*) for the fixing roller 21 (electric energy per predetermined time from the power supply) is lowered when the paper size is decreased, a number of times of lighting the heater 35(*c*) for the pressure roller 22 is increased. As a result, a temperature of a core metal of the pressure roller 22 is increased, and the primer layer of the pressure roller 22 is destroyed. In this embodiment, however, heat degradation of the pressure roller 22 is prevented by lighting the heater 35(*c*) for the pressure roller 22 with the lighting ratio of 20% irrespective of the paper size, as similar to the paper of the A4-size portrait. Table 2 shows the relationship between the lighting ratio of the heater 35(*c*) for the pressure roller and the life duration of the pressure roller 22.

TABLE 2

| Paper size x (mm) | Lighting ratio of pressure heater (%) | Life duration of pressure roller (number of sheets) |
|---|---|---|
| A4-size landscape sheet and others (x ≧ 297) | 20% | 500 K |
| LTR-size landscape sheet and others (279 ≦ x < 297) | 50% | 300 K |
| B4-size landscape sheet and others (257 ≦ x < 279) | 80% | 100 K |
| LGL/envelope and others (x < 257) | 98% | 50 K |

As described above, the life duration of the pressure roller 22 varies by the lighting ratio of the heater 35(*c*) for the pressure roller 22. In this embodiment, by setting the lighting ratio of the pressure roller 22 to 20% irrespective of the paper size, the life duration of the pressure roller becomes not less than 500 K irrespective of the paper size.

Therefore, according to this embodiment, performing the above-described heater control can prevent heat degradation of the pressure roller from occurring. In this embodiment, although the lighting ratio of the heater for the pressure roller is 20%, the similar effects can be obtained as long as the lighting ratio falls within a range of 0 to 20% taking the fixation property or the structure of the pressure roller and the like into consideration.

Figure 7:
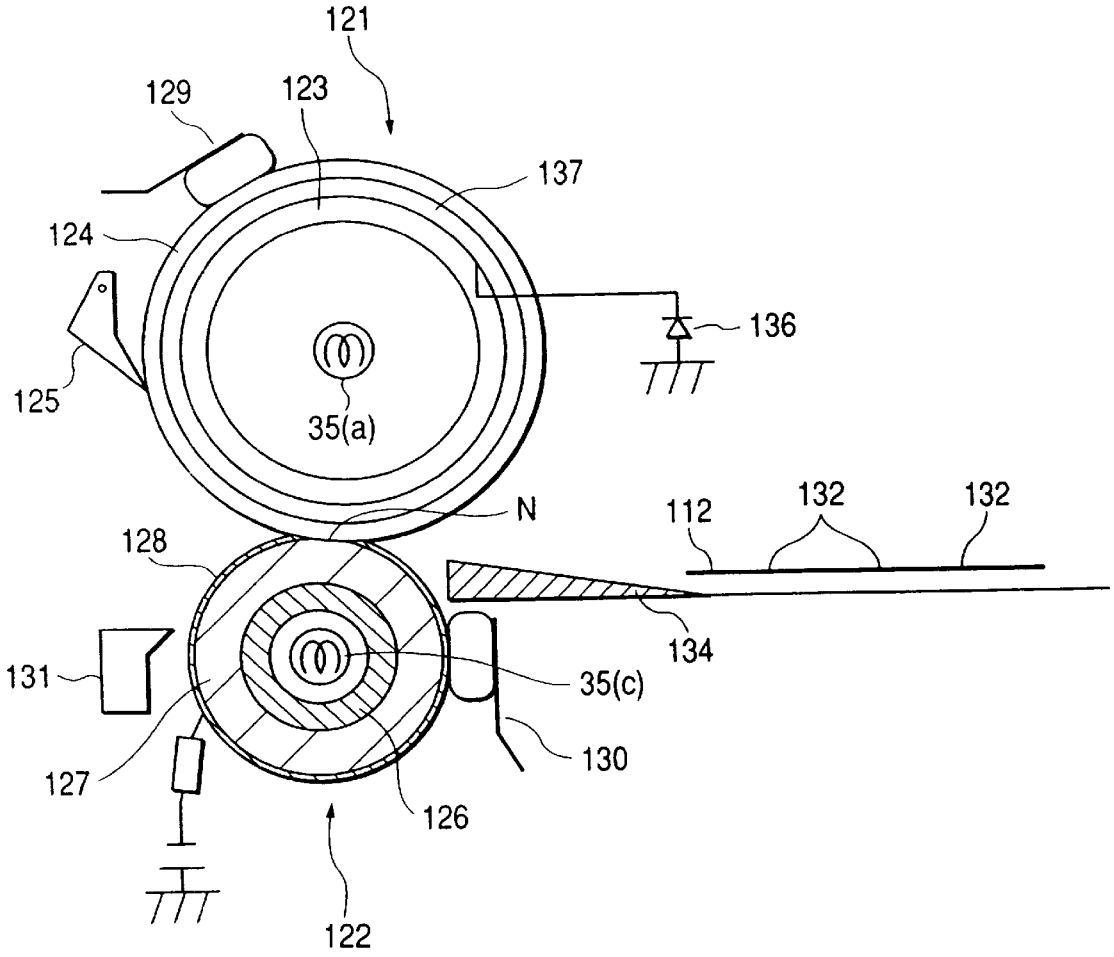
FIG. 7 PRIOR ART
FIG. 7 is a cross-sectional view showing a schematic structure of a conventional fixing apparatus.

Incidentally, as similar to the prior art shown in FIG. 7, it is needless to say that the similar effects can be obtained when a number of the heat source for the fixing roller is one.

Second Embodiment

A second embodiment according to the present invention will now be described. Like reference numerals denote parts similar to the structures in the first embodiment, thereby omitting their explanation.

In this embodiment, a set temperature (limit temperature) for the heater 35(*c*) is determined so as to be small as the width of the paper to be subjected to fixation in a direction orthogonal to the conveying direction is decreased. As a result, the electric energy per predetermined time supplied from the power supply to the heater 35(*c*) is set to be not more than a predetermined quantity, thereby preventing heat degradation of the pressure roller.

That is, in this embodiment, the limit temperature of the pressure roller 22 is different from that in the first embodiment. In the first embodiment, the temperature adjusting thermistor provided to the pressure roller 22 supplies the lighting signal of the heater till a fixed temperature is obtained irrespective of the paper size. In this embodiment, however, the limit temperature of the pressure roller is changed in accordance with the paper size. A temperature detecting device for detecting a surface temperature of the pressure roller 22 is provided to an end portion (non-image area) of the pressure roller 22 in order to control the temperature setting of the pressure roller 22.

In this embodiment, restricting the temperature of the pressure roller can prevent heat degradation of the pressure roller, as shown in Table 3.

TABLE 3

| Paper size x (mm) | Temperature setting in conventional art (°C.) | Temperature setting in this embodiment (°C.) | Life duration of pressure roller: Conventional art | Life duration of pressure roller: This embodiment |
|---|---|---|---|---|
| A4-size landscape sheet and others (x ≧ 297) | 180 | 180 | 500 K | 500 K |
| LTR-size landscape sheet and others (279 ≦ x < 297) | 180 | 170 | 300 K | 500 K |
| B4-size landscape sheet and others (257 ≦ x < 279) | 180 | 165 | 200 K | 600 K |
| LGL/envelope and others (x < 257) | 180 | 160 | 100 K | 650 K |

Therefore, according to this embodiment, varying the limit temperature of the pressure temperature in accordance with the paper size can control the heater lighting and prevent heat degradation of the pressure roller. Incidentally, it is needless to say that the similar effects can be obtained when one heater for the fixing roller is provided.

Third Embodiment

A third embodiment according to the present invention will now be described. It is to be noted that like reference numerals denote parts similar to the structures in the first embodiment, thereby omitting their explanation.

In this embodiment, by configuring the temperature detecting means to detect a temperature of the core metal of the pressure body, the temperature detecting means detects a temperature of the core metal of the pressure body, and the electric energy per predetermined time supplied from the power supply to the pressure body heating means is set to be not more than a predetermined quantity in such a manner that the above-mentioned temperature is maintained at a predetermined temperature or a lower temperature, thereby preventing heat degradation of the pressure roller.

Figure 5:
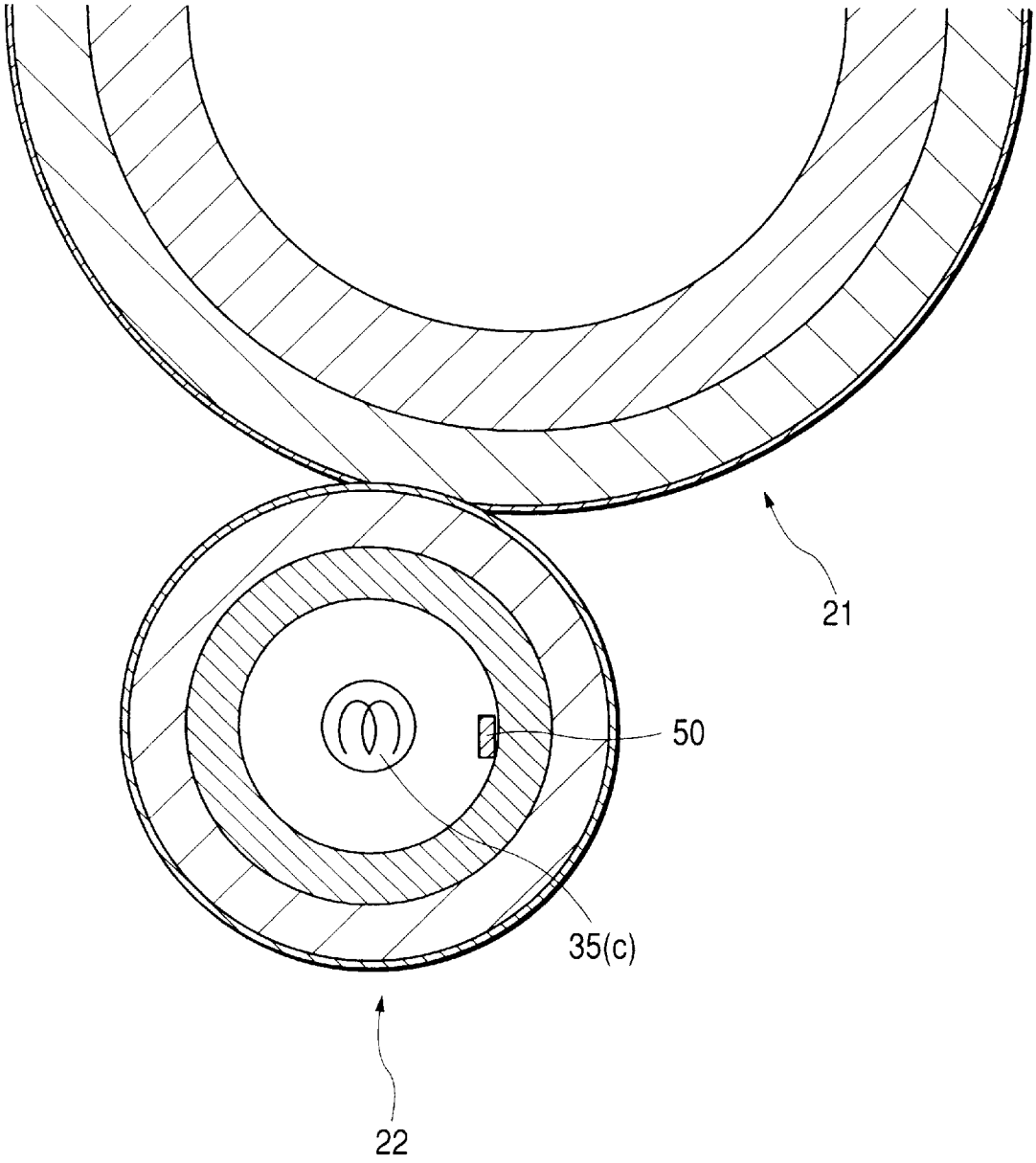
FIG. 5 is a view showing an arrangement position of temperature detecting means in a fixing apparatus according to a third embodiment of the present invention.

FIG. 5 shows a structure of a fixing apparatus used in this embodiment.

A difference of the fixing apparatus according to this embodiment from the structure of the first embodiment is a position at which the thermistor for the pressure roller is set. Although the thermistor is set on the surface of the pressure roller 22 in the fixing apparatus according to the first embodiment as similar to the temperature adjusting thermistor 30 in FIG. 2, setting the thermistor to the core metal of the pressure roller 22 as similar to the temperature adjusting thermistor 50 in FIG. 5 enables accurate detection of a temperature of the core metal and assuredly prevents heat degradation of the pressure roller caused due to increase in the temperature of the core metal in this embodiment.

In this embodiment, the pressure thermistor is set to the core metal, and the temperature adjusting control of the thermistor is effected at 230° C. which is lower than a durability limit temperature of the core metal and the primer layer of the rubber layer by 20° C. As a result, the life duration of the pressure roller is not less than 500 K.

Thus, according to this embodiment, in the mechanism for adjusting a temperature of the pressure roller from the inside, setting the pressure roller thermistor to the core metal of the pressure roller can further effectively prevent heat degradation of the pressure roller. Incidentally, it is needless to say that the similar effects can be obtained by directly detecting a temperature of the core metal of the pressure roller irrespective of a number of heaters for the fixing roller.

Fourth Embodiment

A fourth embodiment according to the present invention will now be described. It is to be noted that like reference numerals denote structures similar to those in the first embodiment, thereby omitting their explanation.

This embodiment shows an example in which heat degradation of the pressure roller is prevented by changing an input voltage to the pressure heater in accordance with the paper size.

A different point is that the input voltage to the pressure heater is changed. As a result, it is possible to suppress rapid increase in the temperature of the core metal of the pressure roller. The input voltage to the pressure heater is classified into three stages in accordance with the paper size by using a constant voltage difference.

Figure 8:
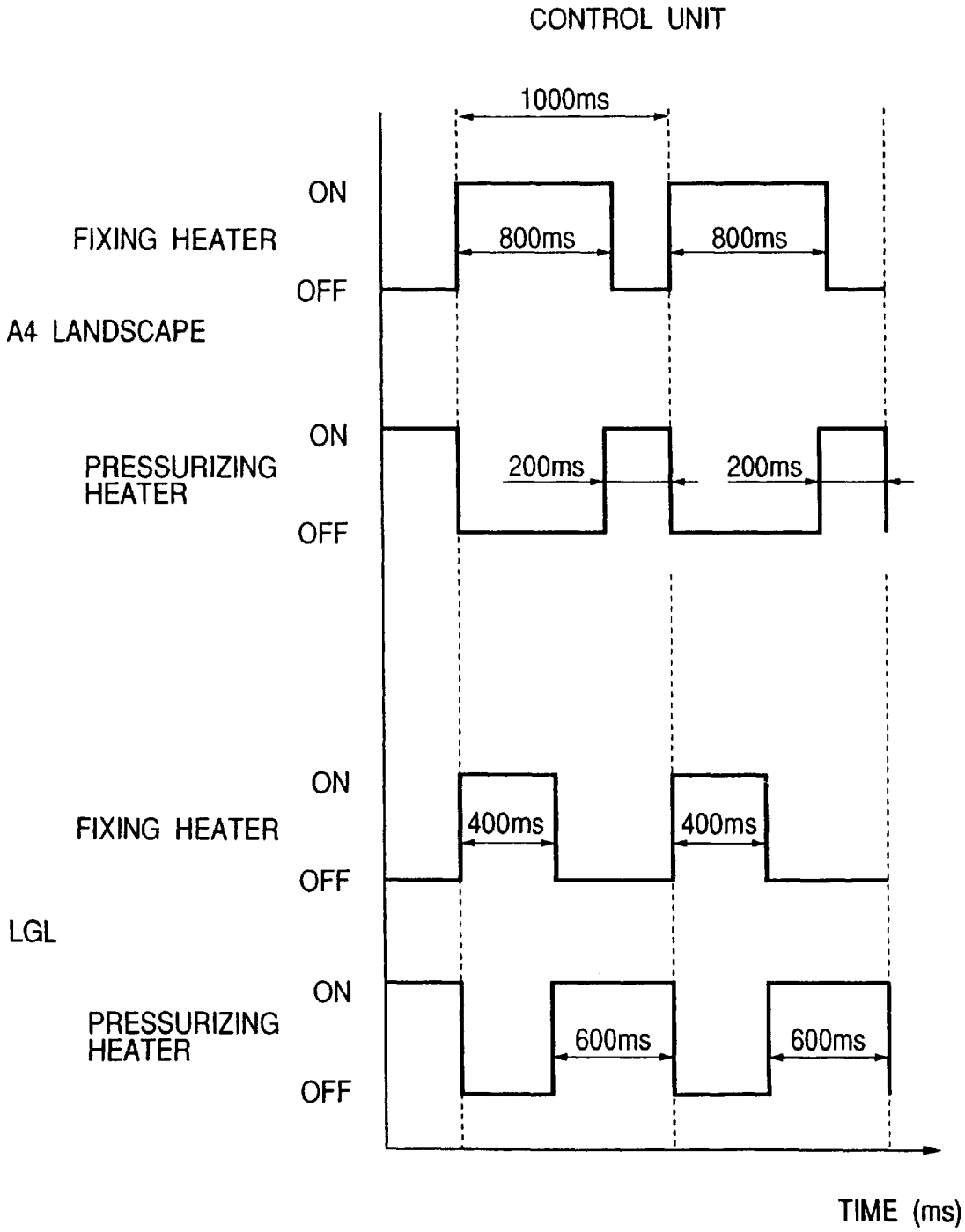
FIG. 8 PRIOR ART
FIG. 8 is a view showing drive timings of fixing body heating means and pressure body heating means in the prior art.

Since the same power supply circuit is used, a voltage of 90 V which is similar to that in the first embodiment is inputted to the sub heater of the fixing roller. As the pressure heater and the sub heater for the fixing roller, heaters with a rated voltage of 90V and 300 V are used. FIG. 8 shows the input voltage used in this embodiment. The heaters 35(*a*) and 35(*b*) are similar to the first embodiment.

Figure 6:
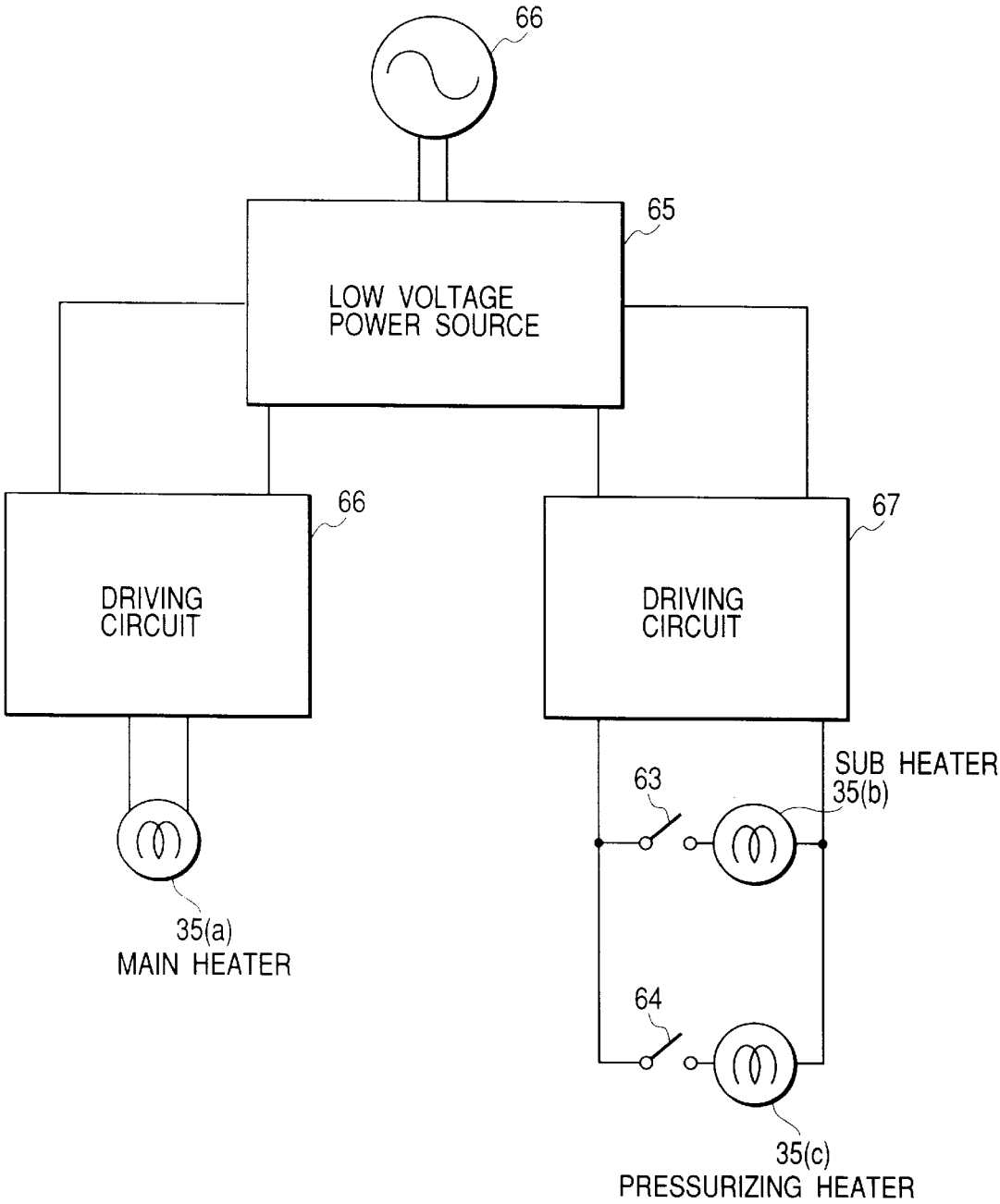
FIG. 6 is a block diagram for illustrating drive control of the fixing body heating means and the pressure body heating means according to a fourth embodiment of the present invention.

The voltage inputted to the heater 35(*c*) is changed by varying an output voltage of the heater 35(*c*) by using the circuit 67 shown in FIG. 6. Table 4 shows the relationship between the input voltage and the life duration of the pressure heater obtained by using the above-mentioned heaters.

TABLE 4

| Paper size x (mm) | Input voltage (V) | Life duration of pressure roller (number of sheets) |
|---|---|---|
| A4-size landscape sheet and others ($x \geqq 297$) | 90 | 500 K |
| B4-size landscape sheet and others ($257 \leqq x < 279$) | 76.5 | 550 K |
| LGL/envelope and others ($x < 257$) | 45 | 650 K |

Thus, according to this embodiment, heat degradation of the pressure roller can be prevented by changing the input voltage when feeding the A4-size landscape paper in accordance with the paper size. It is to be noted that this effect is effective for heat degradation of the pressure roller irrespective of a number of heating sources of the fixing roller.

While the invention has been described with reference to the structure disclosed herein, it is not confined to the details set forth and this application is intended to cover such modifications or changes as may come within the purpose of the improvements or the scope of the following claims.

What is claimed is:

1. A fixing apparatus comprising:

a fixing body and a pressure body which are pressed against each other and rotate;

fixing body heating means for heating said fixing body upon receiving supply of power from a power supply;

pressure body heating means for heating said pressure body upon receiving supply of power from said power supply;

temperature detecting means for detecting a temperature of at least one of said fixing body and said pressure body; and controlling means for controlling supply of power from said power supply to said fixing body heating means and said pressure body heating means in such a manner that a temperature detected by said temperature detecting means becomes a predetermined set temperature, wherein an unfixed image is fixed on a recording medium for bearing the unfixed image by pinching and conveying the recording medium by using said fixing body and said pressure body, and wherein by said controlling means, electric energy per a predetermined time supplied from said power supply to said pressure body heating means is set to a predetermined quantity or a lower quantity by setting a value of a voltage from said power supply to said pressure body heating means so as to be small as a width of the recording medium to be subjected to fixation in a direction orthogonal to a conveying direction is decreased.

2. The fixing apparatus according to claim 1, wherein said controlling means is constituted so that said fixing body heating means and said pressure body heating means are driven by the same power supply circuit.

3. The fixing apparatus according to claim 1, wherein said temperature detecting means is configured to detect a temperature of said pressure body.

4. The fixing apparatus according to claim 1, wherein said temperature detecting means is constituted to detect a temperature of a core metal of said pressure body.

5. The fixing apparatus according to claim 1, wherein said fixing body heating means consists of two fixing body heating bodies which are arranged inside said fixing body, generate heat by using power from said power supply and have luminous intensity distributions different from each other, and the pressure body heating means consists of one pressure body heating body which is arranged inside the heating body and generates heat by using power from said power supply, any one of said two fixing body heating bodies and said pressure body heating body are configured to be driven by the same power supply circuit.

6. The fixing apparatus according to claim 1, wherein by the controlling means, a set temperature for the pressure body heating means is set so as to be small as a width of the recording medium to be subjected to fixation in a direction orthogonal to a conveying direction is decreased, and electric energy per predetermined time supplied from said power supply to said pressure body heating means is thereby set to a predetermined quantity or a lower quantity.

7. An image forming apparatus comprising means for recording an image formed by a series of image forming processes onto a recording medium, and a fixing apparatus for fixing the image recorded on the recording medium, said fixing apparatus including:

a fixing body and a pressure body which are pressed against each other and rotate;

fixing body heating means for heating said fixing body upon receiving supply of power from a power supply;

pressure body heating means for heating said pressure body upon receiving supply of power from said power supply;

temperature detecting means for detecting a temperature of at least one of said fixing body and said pressure body; and controlling means for controlling supply of power from said power supply to said fixing body heating means and said pressure body heating means in such a manner that a temperature detected by said temperature detecting means becomes a predetermined set temperature, wherein an unfixed image is fixed on a recording medium for bearing the unfixed image by pinching and conveying the recording medium by using said fixing body and said pressure body, and wherein by said controlling means, a value of a voltage from said power supply to said pressure body heating means is set so as to be small as a width of the recording medium to be subjected to fixation in a direction orthogonal to a conveying direction is decreased, and electric energy per predetermined time supplied from said power supply to said pressure body heating means is thereby set to be not more than a predetermined quantity.

8. The image forming apparatus according to claim 7, wherein said controlling means is constituted so that said fixing body heating means and said pressure body heating means are driven by the same power supply circuit.

9. The image forming apparatus according to claim 7, wherein said temperature detecting means is constituted to detect a temperature of said pressure body.

10. The image forming apparatus according to claim 7, wherein said temperature detecting means is constituted to detect a temperature of said core metal of said pressure body.

11. The image forming apparatus according to claim 7, wherein said fixing body heating means consists of two fixing body heating bodies which are provided inside said fixing body, generate heat by using power from said power supply and have luminous intensity distributions different from each other, and said pressure body heating means consists of one pressure body heating body which is provided inside said pressure body and generates heat by using power from said power supply, any one of said two fixing body heating bodies and said pressure body heating body being constituted to be driven by the same power supply circuit.

12. The image forming apparatus according to claim 7, wherein by said controlling means, a set temperature for said pressure body heating means is set so as to be small as a width of the recording medium to be subjected to fixation in a direction orthogonal to a conveying direction is decreased, and electric energy per predetermined time supplied from said power supply to said pressure body heating means is thereby set to be not more than a predetermined quantity.

13. A fixing apparatus comprising:

a fixing body and a pressure body which are pressed against each other and rotate;

fixing body heating means for heating said fixing body upon receiving a supply of power from a power supply;

pressure body heating means for heating said pressure body upon receiving a supply of power from said power supply;

temperature detecting means for detecting a temperature of at least one of said fixing body and said pressure body; and controlling means for controlling a supply of power from said power supply to said fixing body heating means and said pressure body heating means in such a manner that a temperature detected by said temperature detecting means becomes a predetermined set temperature, wherein an unfixed image is fixed on a recording medium for bearing the unfixed image by pinching and conveying the recording medium by using said fixing body and said pressure body, and wherein said fixing body heating means consists of two fixing body heating bodies which are arranged inside said fixing body, generate heat by using power from said power supply and have luminous intensity distributions different from each other, and the pressure body heating means consists of one pressure body heating body which is arranged inside the heating body and generates heat by using power from said power supply, any one of said two fixing body heating bodies and said pressure body heating body are configured to be driven by the same power supply circuit.

14. A fixing apparatus according to claim 13, wherein said temperature detecting means is configured to detect a temperature of said pressure body.

15. A fixing apparatus according to claim 13, wherein by the controlling means, a set temperature for the pressure body heating means is set so as to be small as a width of the recording medium to be subjected to fixation in a direction orthogonal to a conveying direction is decreased, and electric energy per predetermined time supplied from said power supply to said pressure body heating means is thereby set to a predetermined quantity or a lower quantity.

16. A fixing apparatus comprising:

a fixing body and a pressure body which are pressed against each other and rotate;

fixing body heating means for heating said fixing body upon receiving supply of power from a power supply;

pressure body heating means for heating said pressure body upon receiving supplying of power from said power supply;

temperature detecting means for detecting a temperature of at least one of said fixing body and said pressure body; and controlling means for controlling supply of power from said power supply to said fixing body heating means and said pressure body heating means in such a manner that a temperature detected by said temperature detecting means becomes a predetermined set temperature, wherein an unfixed image is fixed on a recording medium for bearing the unfixed image by pinching and conveying the recording medium by using said fixing body and said pressure body, and wherein by the controlling means, a set temperature for the pressure body heating means is set so as to be small as a width of the recording medium to be subjected to fixation in a direction orthogonal to a conveying direction is decreased, and electric energy per predetermined time supplied from said power supply to said pressure body heating means is thereby set to a predetermined quantity or a lower quantity.

17. A fixing apparatus according to claim 16, wherein said temperature detecting means is configured to detect a temperature of said pressure body.

18. An image forming apparatus comprising means for recording an image formed by a series of image forming processes onto a recording medium, and a fixing apparatus for fixing the image recorded on the recording medium, said fixing apparatus including:

a fixing body and a pressure body which are pressed against each other and rotate;

fixing body heating means for heating said fixing body upon receiving supply of power from a power supply;

pressure body heating means for heating said pressure body upon receiving supply of power from said power supply;

temperature detecting means for detecting a temperature of at least one of said fixing body and said pressure body; and controlling means for controlling supply of power from said power supply to said fixing body heating means and said pressure body heating means in such a manner that a temperature detected by said temperature detecting means becomes a predetermined set temperature, wherein an unfixed image is fixed on a recording medium for bearing the unfixed image by pinching and conveying the recording medium by using said fixing body and said pressure body, and wherein said fixing body heating means consists of two fixing body heating bodies which are provided inside said fixing body, generate heat by using power from said power supply and have luminous intensity distributions different from each other, and said pressure body heating means consists of one pressure body heating body which is provided inside said pressure body and generates heat by using power from said power supply, any one of said two fixing body heating bodies and said pressure body heating body being constituted to be driven by the same power supply circuit.

19. An image forming apparatus according to claim 18, wherein said temperature detecting means is constituted to detect a temperature of said pressure body.

20. An image forming apparatus according to claim 18, wherein by said controlling means, a set temperature for said pressure body heating means is set so as to be small as a width of the recording medium to be subjected to fixation in a direction orthogonal to a conveying direction is decreased, and electric energy per predetermined time supplied from said power supply to said pressure body heating means is thereby set to be not more than a predetermined quantity.

21. An image forming apparatus comprising means for recording an image formed by a series of image forming processes onto a recording medium, and a fixing apparatus for fixing the image recorded on the recording medium, said fixing apparatus including:

a fixing body and a pressure body which are pressed against each other and rotate;

fixing body heating means for heating said fixing body upon receiving supply of power from a power supply;

pressure body heating means for heating said pressure body upon receiving supply of power from said power supply;

temperature detecting means for detecting a temperature of at least one of said fixing body and said pressure body; and controlling means for controlling supply of power from said power supply to said fixing body heating means and said pressure body heating means in such a manner that a temperature detected by said temperature detecting means becomes a predetermined set temperature, wherein an unfixed image is fixed on a recording medium for bearing the unfixed image by pinching and conveying the recording medium by using said fixing body and said pressure body, and wherein by said controlling means, a set temperature for said pressure body heating means is set so as to be small as a width of the recording medium to be subjected to fixation in a direction orthogonal to a conveying direction is decreased, and electric energy per predetermined time supplied from said power supply to said pressure body heating means is thereby set to be not more than a predetermined quantity.

22. An image forming apparatus according to claim 21, wherein said temperature detecting means is constituted to detect a temperature of said pressure body.

23. A fixing apparatus comprising:

a fixing body and a pressure body which are pressed against each other and rotate, said fixing body and pressure body having a core metal and one or more layers for covering an outer periphery of said core metal respectively, and said one or more layers of said pressure body being thicker than that of said fixing body;

fixing body heating means for heating said fixing body upon receiving supply of power from a power supply;

pressure body heating means for heating said pressure body upon receiving supply of power from said power supply;

pressure body temperature detecting means for detecting a temperature of surface of said pressure body; and controlling means for controlling electric powers supplied from said power supply to said fixing body heating means and said pressure body heating means, wherein said control means controls the electric power supplied from said power supply to said pressure body heating means in such manner that a temperature of said core metal of said pressure body is not excessively higher than that of the surface of said pressure body.

24. A fixing apparatus according to claim 23, wherein said apparatus comprises first and second fixing body heating means.

25. A fixing apparatus according to claim 24, wherein said controlling means controls electric powers supplied from said power supply to said first and second fixing body heating means in accordance with a temperature of surface of said fixing body.

26. A fixing apparatus according to claim 25, wherein said controlling means duty controls supply of power to said second fixing body heating means and said pressure body heating means so that power is not supplied to said pressure body heating means when power is supplied to said second fixing body heating means, and said controlling means controls an electric power supplied from said power supply to said pressure body heating means to limit duty of supply of power to said pressure body heating means to a predetermined duty or less regardless of a size of a recording medium and duty of supply of power to said second fixing body heating means so that a temperature of said core metal of said pressure body is not excessively higher than that of the surface of said pressure body.

27. A fixing apparatus according to claim 24, wherein said controlling means varies a target temperature of the surface of said pressure body and a voltage supplied to said pressure body heating means in accordance with a size of a recording medium to control an electric power supplied from said power supply to said pressure body heating means so that a temperature of said core metal of said pressure body is not excessively higher than that of the surface of said pressure body.

28. A fixing apparatus according to claim 27, wherein said controlling means duty controls supply of power to said second fixing body heating means and said pressure body heating means so that power is not supplied to pressure body heating means when power is supplied to said second fixing body heating means, and said controlling means varies the target temperature for the temperature of the surface of said pressure body in accordance with the size of the recording medium.

* * * * *

UNITED STATES PATENT AND TRADEMARK OFFICE

CERTIFICATE OF CORRECTION

PATENT NO. : 6,516,165 B2 
DATED : February 4, 2003
INVENTOR(S) : Tomoyuki Makihira et al.

It is certified that error appears in the above-identified patent and that said Letters Patent is hereby corrected as shown below:

Title page,
Item [57], ABSTRACT,
Line 7, "a" (2nd occurrence) should read -- an --.

Column 1,
Line 18, "order" should read -- order to --.
Line 42, "the both" should read -- both the --.
Line 56, "constituted" should read -- constituted by --.

Column 6,
Line 53, "the both" should read -- both the --.

Signed and Sealed this

Twenty-sixth Day of August, 2003

JAMES E. ROGAN
*Director of the United States Patent and Trademark Office*